US010465357B1

(12) United States Patent
Brown

(10) Patent No.: US 10,465,357 B1
(45) **Date of Patent: *Nov. 5, 2019**

(54) SYSTEM AND METHOD FOR STABILIZATION OF STRUCTURES BY CONTROL OF SOIL MOISTURE CONTENT

(71) Applicant: Arizona Foundation Solutions, LLC, Phoenix, AZ (US)

(72) Inventor: Robert K. Brown, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/824,850

(22) Filed: Nov. 28, 2017

Related U.S. Application Data

(63) Continuation of application No. 14/498,838, filed on Sep. 26, 2014, now Pat. No. 9,828,740.

(60) Provisional application No. 61/985,987, filed on Apr. 29, 2014.

(51) Int. Cl.

| | |
|---|---|
| ***E04B 1/92*** | (2006.01) |
| ***E02D 31/12*** | (2006.01) |
| ***E02D 33/00*** | (2006.01) |
| ***E02D 31/14*** | (2006.01) |
| ***E02D 31/02*** | (2006.01) |
| ***E02D 19/00*** | (2006.01) |
| ***E02D 3/00*** | (2006.01) |
| ***E02D 1/08*** | (2006.01) |

(52) U.S. Cl.
CPC ..... *E02D 31/12* (2013.01); *E02D 1/08* (2013.01); *E02D 3/00* (2013.01); *E02D 19/00* (2013.01); *E02D 31/02* (2013.01); *E02D 31/14* (2013.01); *E02D 33/00* (2013.01); *E04B 1/92* (2013.01)

(58) Field of Classification Search
CPC ..... E02D 31/12; E02D 1/08; E02D 33/00; E02D 19/00; E02D 31/02; E02D 31/14; E02D 3/00; E04B 1/92
USPC ..... 52/169.5
See application file for complete search history.

(56) References Cited

U.S. PATENT DOCUMENTS

| | | | |
|---|---|---|---|
| 4,295,415 | A | 10/1981 | Schneider, Jr. |
| 4,760,674 | A | 8/1988 | Brand et al. |
| 4,843,786 | A | 7/1989 | Walkinshaw et al. |
| 5,356,240 | A | 10/1994 | Schuler |
| 5,620,368 | A | 4/1997 | Bates et al. |

(Continued)

FOREIGN PATENT DOCUMENTS

| | | |
|---|---|---|
| GB | 2377716 | 1/2003 |

OTHER PUBLICATIONS

Building Science Corporation, "Enclosures That Work, Building Profile: Mixed-Humid Climate: Atlanta", Apr. 27, 2009, http://www.buildingscience.com/documents/profiles/etw-atlanta-profile.

*Primary Examiner* — Basil S Katcheves
(74) *Attorney, Agent, or Firm* — Booth Udall Fuller, PLC

(57) ABSTRACT

A soil stabilization system for a structure can include a stem wall and floor slab disposed within a perimeter of the stem wall. An aggregate base course (ABC) layer can be disposed within a perimeter of the stem wall and below the floor slab. A ventilation opening can extend to the ABC layer, and an air exhaust system can extend between the ABC layer and an exterior of the structure. A method of soil stabilization for a structure can include measuring a moisture content of an expansive soil below a structure, drawing dry air through the ABC layer and over a surface of an expansive soil. Moisture can be removed from the expansive soil into the dry air by evaporation to create moist air, and moist air can be evacuated at an exterior of the structure.

20 Claims, 7 Drawing Sheets

(56) References Cited

U.S. PATENT DOCUMENTS

| | | | | |
|---|---|---|---|---|
| 5,881,951 | A | 3/1999 | Carpenter | |
| 5,908,045 | A | 6/1999 | Wallace et al. | |
| 6,706,096 | B2 | 3/2004 | Sanglerat et al. | |
| 7,143,558 | B2 | 12/2006 | Trotter | |
| 7,414,525 | B2 | 8/2008 | Costea et al. | |
| 9,828,740 | B1 * | 11/2017 | Brown | E02D 31/12 |
| 2005/0196577 | A1 | 9/2005 | Riste | |
| 2012/0328378 | A1 | 12/2012 | Hatton et al. | |

* cited by examiner

SYSTEM AND METHOD FOR STABILIZATION OF STRUCTURES BY CONTROL OF SOIL MOISTURE CONTENT

RELATED APPLICATIONS

This application is a continuation of U.S. utility patent application Ser. No. 14/498,838, filed Sep. 26, 2014 titled "System and Method for Stabilization of Structures by Control of Soil Moisture Content," which claims the benefit of U.S. provisional patent application 61/985,987, filed Apr. 29, 2014 titled "Stabilization of Structures by Control of Soil Moisture Content," the entirety of the disclosures of which are incorporated herein by this reference.

TECHNICAL FIELD

This disclosure relates to a system and method of stabilizing structures to reverse or prevent heave and settling through control of soil moisture content of expansive soils.

BACKGROUND

Many structures, including buildings such as homes, offices, retail space, and manufacturing space, are built with at least a portion of the building in direct contact with soils. Soils provide a base or platform on which the building can rest that can serve to support the building. Soils can exhibit fluid characteristics, and as a consequence, a solid base such as a foundation, is generally provided as part of building construction. While a foundation may provide a more stable substructure than bare soil, the fluid properties of soils can compromise a foundation, or cause the foundation to fail. Many different types of soils are encountered in different geographic locations and in different building situations, which can require adaptations so that the building foundation interacts with the soil in such a way as to provide adequate support and reduces, minimizes, or maintains relative movement of the building and the soil within acceptable tolerances.

When relative movement between a building and the soil upon which the building is built or rests is exposed to, or undergoes, excessive relative movement, stress (force per area) develops on the building and can result in strain (deformation per unit length), movement, shifting, and breakage of the building, including the foundation. Movement of soils can occur quickly such as with earthquakes and liquefaction, or more slowly, as with heaving and settling. Repairs relating to structural foundation problems amount to roughly $55 billion a year in the United States. In fact, in some areas, such as the greater Phoenix Metro Area of the State of Arizona, roughly half of remodels that involve additions or expanding a footprint of a building experience foundation problems, which can lead to costly repairs.

FIG. 1A shows a cross-sectional view of a portion of a structure or house 10 that is built using slab on grade construction. Structure 10 can comprises footings 12 and stem walls 14 that together form foundation 16. Footing can be made or concrete reinforced with steel, such as rebar. Stem walls 14 can similarly be reinforced concrete, or alternatively can be masonry or block. Together, foundation 16 can support a superstructure or a balance of structure 10 including walls 18 and a roof 20. Both walls 18 and roof 20 can be constructed of lumber. Alternatively, walls 16 can be constructed or masonry, block, or any other suitable material.

Foundation 16 can be disposed in, and supported by, native soil 124. Soil 24 can also provide support for floor slab 26. Slab on grade construction include a concrete floor slab 26 that can be poured, formed, or built within a perimeter formed by the stem wall 14. Floor slab 26 can be in contact, and often direct contact, with leveled or graded soil. The graded soil can be formed as a prepared pad of soil that has been compacted for stability and built to a particular elevation or grade to account for drainage away from the building and other issues. Advantageously, an intermediate layer of engineered soil or an aggregate base course (ABC) 28 comprising rock, sand, and dirt can be deposited, graded, wet, and compacted over native soil 24 before placing and finishing concrete floor slab 26. ABC layer 28 can generally comprises a thickness in a range of 7.6-15.2 centimeters (cm) or about 10.2 cm (or 3-6 inches (in.), or about 4 in.). The placement and use of ABC layer 28 between native soil 24 and floor slab 26 reduces soil movement and attendant cracking of floor slab 26. Floor slab 26 can be formed of a layer of concrete that can generally comprises a thickness in a range of 7.6-15.2 cm or about 10.2 cm (or 3-6 in., or about 4 in.).

FIG. 1B shows a cross-sectional view of a portion of a structure 10, similar to the view shown in FIG. 1A. FIG. 1B provides an illustration of structural damage that can result from upward movement or heaving of native soil 24 when the native soil is or comprises an expansive soil 30, such as clay. When expansive soil 30 becomes wet or increases in moisture content, the expansive soil swells and increases in size so that a top surface of the soil moves upward. When soil is constrained on its upper surface, such as by structure 10, the soil can lift, shift, and move footings, stem walls, floor slabs, as well as walls and roofs attached to the footings, stem, and slab. Excessive movement, especially differential movement, of various portions of structure 10 can cause cracking and failure of the various portions. FIG. 1B shows a broken floor slab 32 comprising uneven surface 34 and cracks 36 that were caused by the uplift of heaving soil 30. While the heaving of expansive soil has been shown with respect to uplift caused by the moisture content of a dry expansive soil increasing, the opposite can also occur. In situations where the moisture content of a wet expansive soil decreases, soil shrinkage and settling can occur with similar results of differential movement and structural damage.

SUMMARY

A need exists for a system and method for stabilization of structures by control of soil moisture content. Accordingly, in an aspect, a method of soil stabilization for a structure can comprise measuring a moisture content of an expansive soil below a structure, drawing dry air through an ABC layer and over a surface of an expansive soil, removing moisture from the expansive soil into the dry air by evaporation to create moist air, and evacuating the moist air at an exterior of the structure.

The method of soil stabilization for a structure can further comprise pulling ambient air through a ventilation opening formed in a stem wall of the structure, and evacuating the moist air from the ABC layer by pulling the moist air through an air exhaust system to an exterior of the structure. The method can further comprise adjusting a cover coupled to the ventilation opening to adjust an airflow through the ventilation opening. The method can further comprise measuring the moisture content of the expansive soil at a distance greater than or equal to 0.9 meters from every footing of the structure. The method can further comprise drawing the dry air through the ABC layer and evacuating the moist air by operating a fan when a measured moisture content of the expansive soil below the structure is greater than or equal to 5 percent. The method can further comprise operating more than one fan to control an airflow below different portions of the structure.

In another aspect, a method of installing a soil stabilization system for a structure can comprise forming a ventilation opening that extends through a stem wall to an ABC layer below a floor slab, forming an opening through the floor slab to the ABC layer, forming a cavity in the ABC layer below the opening, placing a moisture sensor in an expansive soil below the floor slab and below the ABC layer, and coupling a first portion of an air exhaust system within the cavity.

The method of installing a soil stabilization system can further comprise disposing a second portion of the air exhaust system in a space external to the structure. The method can further comprise coupling a variable speed fan to the air exhaust system so the fan is positioned to draw air from the ABC layer to at least one portion of the air exhaust system. The method can further comprise installing the soil stabilization system during original construction of the structure. The method can further comprise installing the soil stabilization system after original construction of the structure. The method can further comprise disposing an air intake pipe comprising a length greater than or equal to 0.9 meters through the ventilation opening and into the ABC layer. The method can further comprise placing the moisture sensor in the expansive soil at a distance greater than or equal to 3 from every footing of the structure.

In another aspect, a soil stabilization system for a structure can comprise a structure comprising a stem wall and floor slab disposed within a perimeter of the stem wall, an ABC layer disposed within a perimeter of the stem wall and below the floor slab, a ventilation opening that extends to the ABC layer, and an air exhaust system that extends between the ABC layer and an exterior of the structure.

The soil stabilization system for a structure can further comprise system wherein the ventilation opening extends through the stem wall to the ABC layer. An air intake pipe can comprise a length greater than or equal to 0.6 meters that extends through the ventilation opening and into the ABC. The air exhaust system can comprise an air exhaust pipe, a manifold coupled to a first end of the air exhaust pipe disposed adjacent the ABC layer, a fan coupled to the air exhaust pipe, and a second end of the air exhaust pipe disposed outside the structure. The air exhaust system can comprise an air exhaust pipe that extends below the floor slab from a cavity to a periphery of the structure. The air exhaust system can comprise an air exhaust pipe that extends above the floor slab from a cavity to a periphery of the structure. The system can further comprise a moisture sensor disposed in an expansive soil at a distance greater than or equal to 0.9 meters from every footing of the structure.

DETAILED DESCRIPTION

Figure 1A:
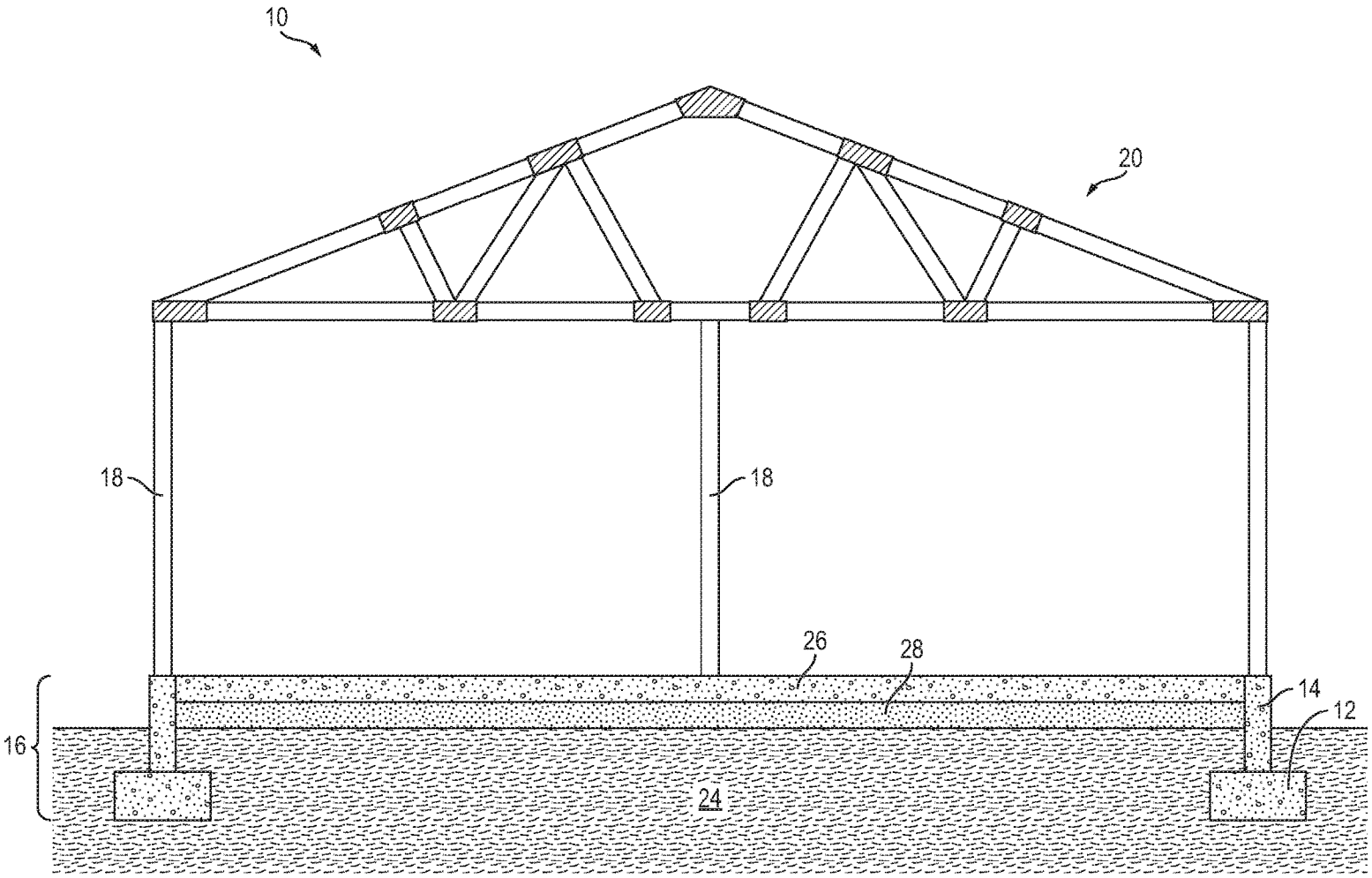
FIG. 1A (Prior Art)
FIGS. 1A and 1B show cross-sectional views of structures as known in the prior art.

This disclosure, its aspects and implementations, are not limited to the specific helmet or material types, or other system component examples, or methods disclosed herein. Many additional components, construction and assembly procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

FIGS. 2A-4 show non-limiting examples of structure stabilization by control of soil moisture content. Expansive soils include soils comprising a high content of clay that are prone to large volume changes that are directly related to changes in water content. Expansive clay soils, such as montmorillonite and bentonite can have large shrink-swell capacities and can shrink and form deep cracks when dried as well as expand to cause heaving when wet.

Heaving is generally a problem for dry inland areas that have historically dry soils before building construction, such as the greater Phoenix Metro area in the state of Arizona, and the Sunbelt of the American Southwest. After building construction and landscaping, water seeps or percolates down around building edges as a result of rain falling from a roof edge, water collecting from irrigation watering systems, or other similar process. Water can then pool and accumulate under and adjacent the building and the building's foundation, where the water does not have a pathway to escape from below the building. The water is effectively trapped below the building, increasing a moisture content of the soil and causing expansive soils, such as clay, to expand and heave, pushing a building or portions of the building upward.

On the other hand, settling can be a problem for wet areas that have historically wet soils before building construction, such as the greater Dallas Metro area in the state of Texas. After building construction, water seeps or percolates down and away from the building, resulting in drier soil conditions. Decreasing moisture content of the soil can causing expansive soils, such as clay, to contract and settle, moving away from portions of the building causing settling or downward movement of the building. Buildings constructed upon expansive soils can be susceptible to damage as underlying soils swell and shrink according to temperature, humidity, vegetation, storm events, or other factors.

At greater depths the soil conditions might be more stable, for example due to relative impermeability of the soil, the weight of overlying soil at a specified depth, or other factors. Soils at greater depths can also be more stable because of the weight of overlying soil that prevents, minimizes, or attenuates movement of soil, such as with swelling and shrinking of expansive soils. As a general rule of thumb, about 90% of problems arising from shrinking and swelling of expansive soils occur within about a top 0.9 meters (m) (or about 3 feet) of soil. Thus, soil conditions can be more stable at a depth at which a base of the foundation or footing is disposed, such as at about 0.9 m, and can be substantially resistant to fluctuations that occur at lesser depths. However, even with stable soil at a depth of a footing of a building, portions of the building like floor slabs may still be exposed to, and damaged by, fluctuations in the upper levels of the soil. Some soils, like sandy and silty soils, may be highly variable and fluctuate at even significant depths. By contrast, some soils like rocky soils may be more resistant to fluctuations in soil elevation and may be better suited to foundations disposed at lesser or shallower depths within the soil. Accordingly, prevention and minimization of damage resulting from shrinking and swelling of expansive soils can generally focus on upper areas of soil with less overburden, and can also target lower areas of soil with a greater overburden.

Thus, even if the footings of a building foundation are formed at a depth such that the foundation is relatively undisturbed by expansion and contraction of soil, buildings employing a slab on grade design can still be subject to problems of settling and heaving because of the close proximity or direct contact between a floor slab and soil.

Figure 1B:
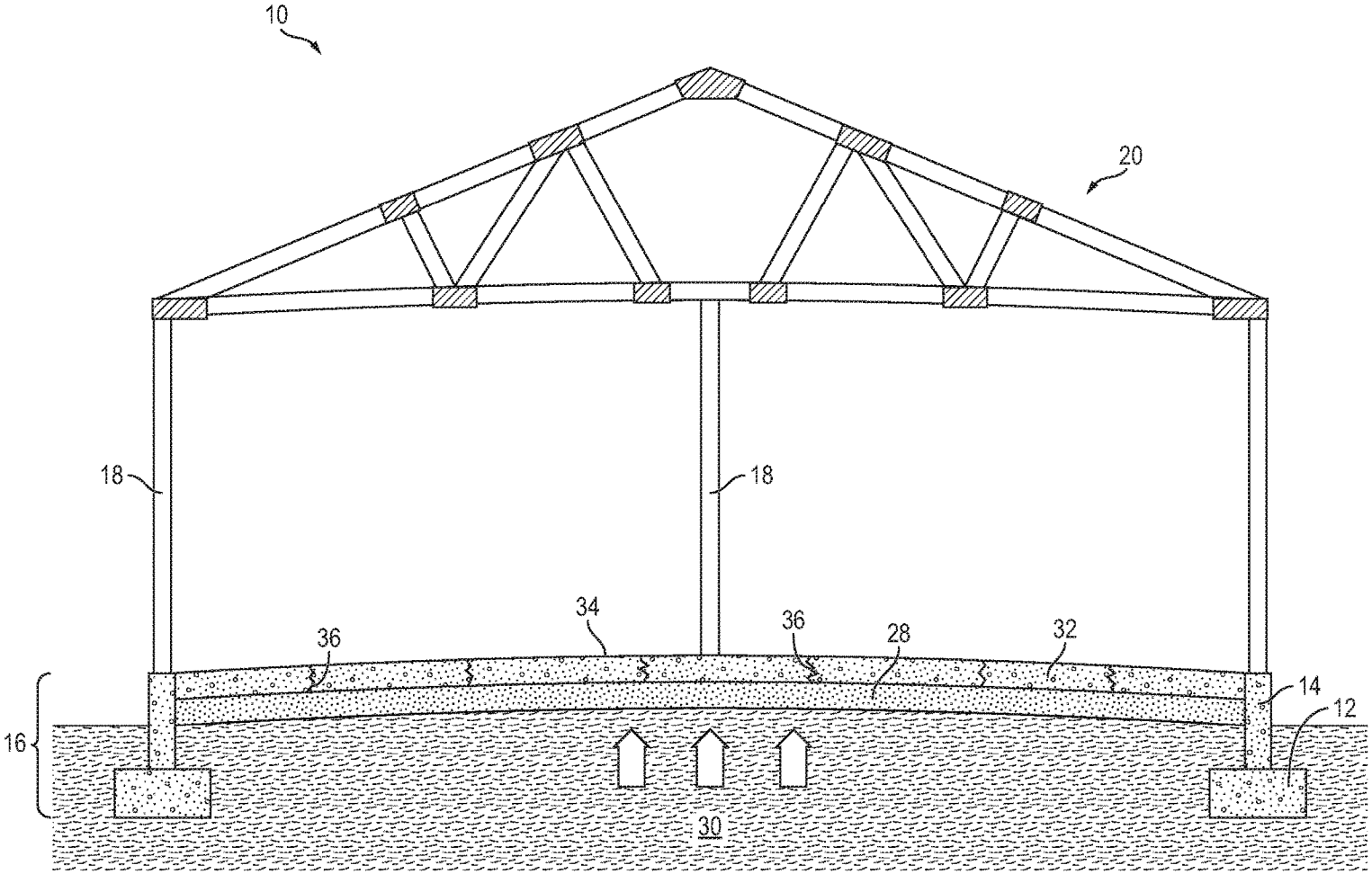
FIG. 1B (Prior Art)
Figure 2A:
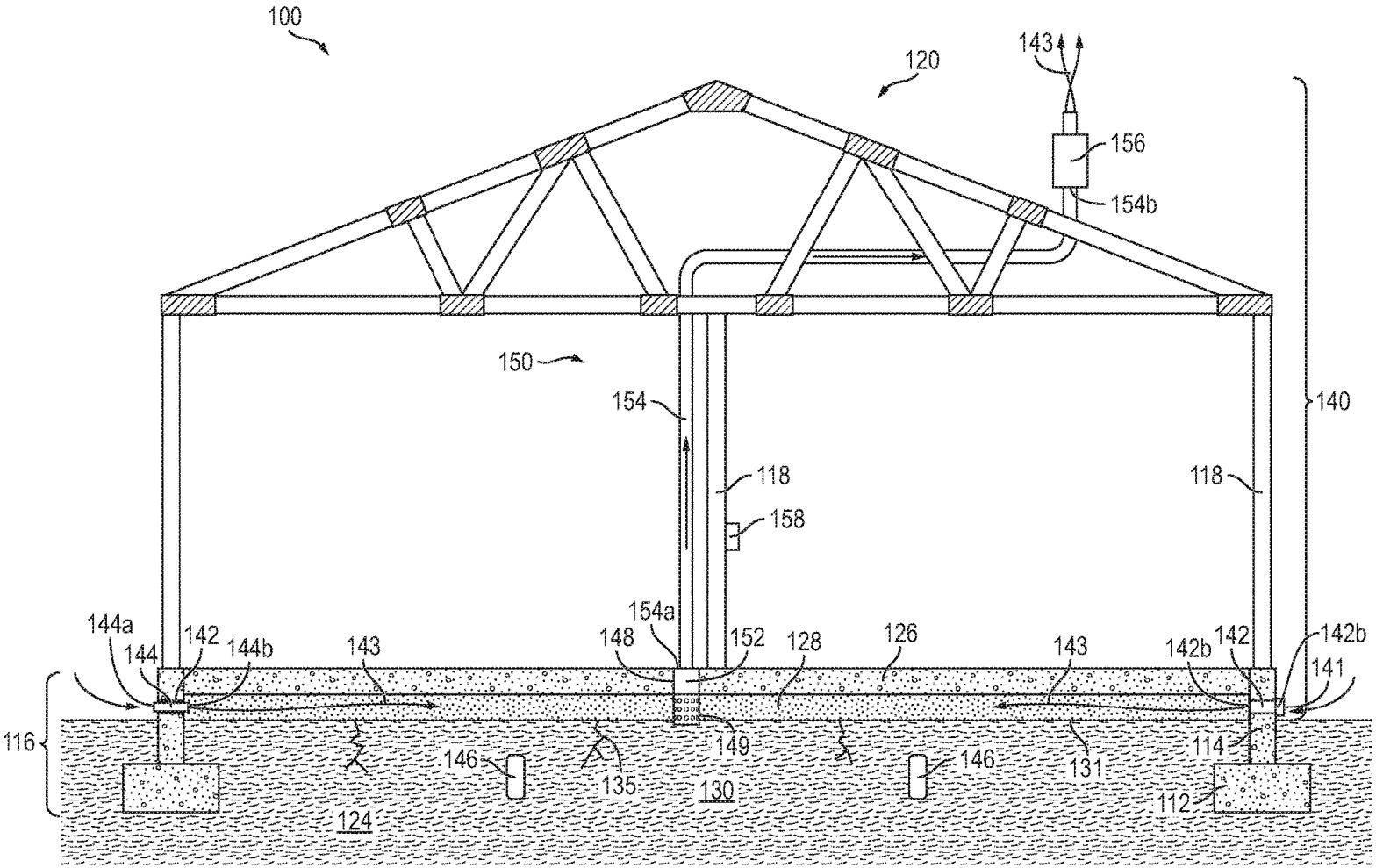
FIGS. 2A and 2B show a cross-sectional and a plan view, respectively, of aspects of a system for stabilizing structures by control of soil moisture content.

FIG. 2A shows a cross-sectional schematic view of a structure 100 that can be formed as a slab on grade structure similar to structure 10 shown in FIGS. 1A and 1B. More specifically, structure 100 comprises foundation 116 that includes footings 112 and stem wall 114, walls 118, roof 120, and a floor slab 126 that is disposed over ABC layer 128 and native soil 124, which is an expansive soil 130. Structure 100, foundation 116, footing 112, stem wall 114, walls 118, roof 120, floor slab 126, ABC layer 128, native soil 124, and expansive soil 130 can be similar or identical to structure 10, foundation 16, footing 12, stem wall 14, walls 18, roof 20, floor slab 26, ABC 28, native soil 24, and expansive soil 30, respectively. Structure 100 of FIG. 2 differs from structure 10 of FIGS. 1A and 1B in that the structure 100 includes a soil moisture control system 140 that can increase, decrease, or both, a moisture content of ABC layer 128 and expansive soil 130 on which structure 10 is built, thereby controlling soil contraction and expansion, as well as mitigating building settling and heaving.

As shown in FIG. 2A, soil moisture control system 140 can comprise ventilation openings or holes 142, one or more moisture sensors 146, an opening 148 in floor slab 126, and an air exhaust system 150 comprising a manifold or perforated compartment 152, an air exhaust pipe, tube, or conduit 154, and a fan 156. While an embodiment of moisture control system 140 shown in FIG. 2A is, for convenience, described with respect to reducing moisture content of expansive soil 130 to reduce or prevent heaving, the moisture control system can also be used to increase moisture content of the soil to prevent or reduce settling. Additionally, moisture content as used herein can refer to either a portion or percentage of moisture, such as liquid water, gaseous water, or both, determined by volume, weight, or both. Accordingly, moisture control system 140 can provide for removal of moisture from expansive soil 130, on which structure 100 is disposed, by forming ventilation openings 142 in stem wall 114 to allow an airflow 143 of dry ambient air from around an exterior of structure 100 to be drawn through a space or voids between particles of aggregate in ABC layer 128 between floor slab 126 and expansive soil 130 to the air exhaust system 150. Airflow 143 can arrive at manifold or perforated compartment 152 at a first end of air exhaust system 150. Manifold 152 can be centrally located within a footprint of structure 100. As the dry air passes over moist expansive soil 130, moisture is transferred from surface 131 of expansive soil 130 to the dry air by evaporation, thereby drying the expansive soil. Airflow 143 comprising moistened air can then arrive at air exhaust system 150 to be drawn out of the building into the dry ambient air by fan 156. Various aspects of soil moisture control system 140 are considered below.

Ventilation openings or holes 142 can be formed in stem walls 114 at the time the stem wall is formed during initial construction, or alternatively, ventilation openings 142 can be formed after the initial formation of the stem wall, such as by removing a portion of the stem wall by drilling or other suitable process. A number and size of ventilation openings 142 can vary according to a size of structure 100, an amount of moisture to be removed from expansive soil 130, a difference in moisture and ambient air humidity, and a configuration of air exhaust system 150 including a number of manifolds 152. In some embodiments, a total of 3-10 or 4-5 ventilation openings 142 will be used for an entire structure 100, such as a residential home comprising a footprint in a range of about 130-335 square meters ($m^2$) (or about 1,400-3,600 square feet ($ft^2$)). As such, one ventilation opening 142 can be used for about every 10-110 $m^2$ or 65-85 $m^2$ (or about every 140-1,200 $ft^2$ or 700-900 $ft^2$) of building area. In some embodiments, a single ventilation opening 142 can be disposed on each side or edge of structure 100, such as through a portion of stem wall 114 on each side or edge of structure 100. In other embodiments, a ventilation opening 142 can be disposed about every 1.5-15.5 m (or 5-50 feet) on each side or edge of structure 100, such as through a portion of stem wall 114. A length of ventilation openings 142 between first side 142*a* and second side 142 of the ventilation openings can be a width or thickness of stem wall 114, such as about 7.6-20.3 cm, or 10.2-15.2 cm (or about 3-8 in. or 4-6 in.). A diameter or cross-sectional length of ventilation opening 142, taken in a direction transverse or perpendicular to the length of ventilation opening 142 can be in a range of about 0.16-5.08 cm, or about 1.3-2.5 cm, or about 1.9 cm (or about 1/16 to 2 in., or about ½ to 1 in., or about ¾ in.). A cross-sectional area of ventilation opening can comprise a shape that is circular, oval, square, rectangular, or any other geometric or organic shape.

A first side 142*a* of ventilation opening 142 can be exposed on an outer surface of stem wall 114 on an outside of structure 100. Opening 142 can be formed above ground level, or above a level at which soil 124 contacts stem wall 114 on an outside of structure 100. As such, end 142*a* of ventilation opening 142 is exposed to dry ambient air outside of structure 100. Ventilation openings 142 can be horizontal or flat, as shown in FIG. 2, and can also be angled or slanted through the stem wall. In other embodiments, ventilation openings can pass through walls 118 and floor slab 126, or through walls 118 and between a space or opening between stem 114 and floor slab 126 to provide ventilation of ambient air to ABC layer 128. As such, second end 142*b* of ventilation opening can be disposed adjacent ABC layer 128. When opening 142 extends through stem wall 116, second end 142*b* can be opposite first end 142*a* and disposed on an inside surface of stem wall 114, wherein second end 142*b* can be vertically disposed between floor slab 126 and expansive soil 130. Advantageously, voids or spaces within ABC layer 128 can contact or be open to second side 142*b* of ventilation opening 142, and the voids or spaces will be sufficiently large to permit airflow from outside structure 100, through the ABC layer, across surface 131 of expansive soil 130, and out away from structure 100 in sufficient quantities to remove a desired amount of moisture from the expansive soil. In some embodiments, larger voids can be preserved around the second side 142*b* of ventilation opening 142 to allow for increased airflow 143. Second end 142*b* can be configured to prevent a portion of ABC layer 128 from entering opening 142, such as by applying a grate, filter, or screen to second side 142. Airflow 143 through a totality of ventilation openings 142 (or out through air exhaust system 150) can be in a range of about 280-280,000 cubic cm ($cm^3$) per second (or about 0.01-10 cubic feet per second (CFS)). Regardless of a volume of air entering ventilation openings 142 or exiting air exhaust system 150, pressure within the ventilation openings and the air exhaust system can be in a range of 0-20 micro pascals (μPa), or 5-11 μPa. An amount of airflow 143 through ventilation openings 142 can also be adjusted by adjusting a surface area exposed on a first side 142*a* or a second side 142*b* of ventilation opening 142, or a first side 144*a* or a second side 144*b* of air intake pipe 144, such as by adjusting a cover, insert, grate, filter, or screen 141 coupled to the ventilation opening or air intake pipe. Cover 141 can comprise a knob, dial, flange, slat, or other suitable structure that can be moved rotationally or transnationally by being pushed, pulled, twisted, or slid, so that an element of the cover such as a slat, fin, cover, or other portion can be moved to increase or decrease a size of an opening over ventilation openings 142 to increase or decrease airflow 143 through the ventilation openings. A portion of ABC layer 128 can also be prevented from entering, blocking, or limiting airflow 143 through opening 142 by inserting air intake pipes 144 into openings 142.

Air intake pipes 144 can be plastic such as PVC or ABS, as well as metal such as copper, iron, cast iron, stainless steel, galvanized steel, or any other suitable material. An outer diameter or cross-sectional length of air intake pipes 144 can be equal, substantially equal, or slightly smaller than the diameter or cross-sectional distance of ventilation opening 142. Similarly, a cross-sectional area of air intake pipes 144 can be equal or substantially equal to a cross-sectional area of ventilation openings 142 so that intake pipes 144 can be coupled or fixed within ventilation openings 142 using friction, adhesive(s), or both. Air intake pipes 144 can be used to define ventilation openings 142, and at least a portion of a pathway for airflow 143, and as such, can include any of the dimensions, designs, orientations, or features described above with respect to ventilation openings 142.

Air intake pipes 144 can be arranged or oriented so that ABC layer 128 can be prevented from entering air intake pipes 144. For example, a downward facing curve, bend, or joint can be placed at first side 144*a* or second side 144*b* of air intake pipe 144 so that the sides are shielded from gravity pulling material, such as material from ABC layer 128, into the sides of the air intake pipe. Additionally, the first side 144*a* and the second side 144*b* of air intake pipe 144 can include a cover 141 to prevent ABC layer 128 or other material from entering air intake pipe 144. Air intake pipes 144 can be optionally disposed within ventilation openings 142, and may be disposed within an entirety of ventilation openings 142, or in a plurality of ventilation openings less than the entirety. For example, air intake pipes 144 can also be directed away from the ground to prevent debris and other unwanted matter from entering ventilation openings 142 or air intake pipe 144. A first opening 144*a* of an air intake pipe 144 can be disposed away from ventilation opening 142. For example, air intake pipe 144 can be integrated within a wall 118, and a first opening 144*a* can be disposed away from a ground level, such as at an eave of structure 100, or even in an attic of the structure. In some embodiments, by drawing hot dry air in from the attic, more moisture can be caused to evaporate from expansive soil 130 than would otherwise be withdrawn by ambient air from without the building.

Figure 2B:
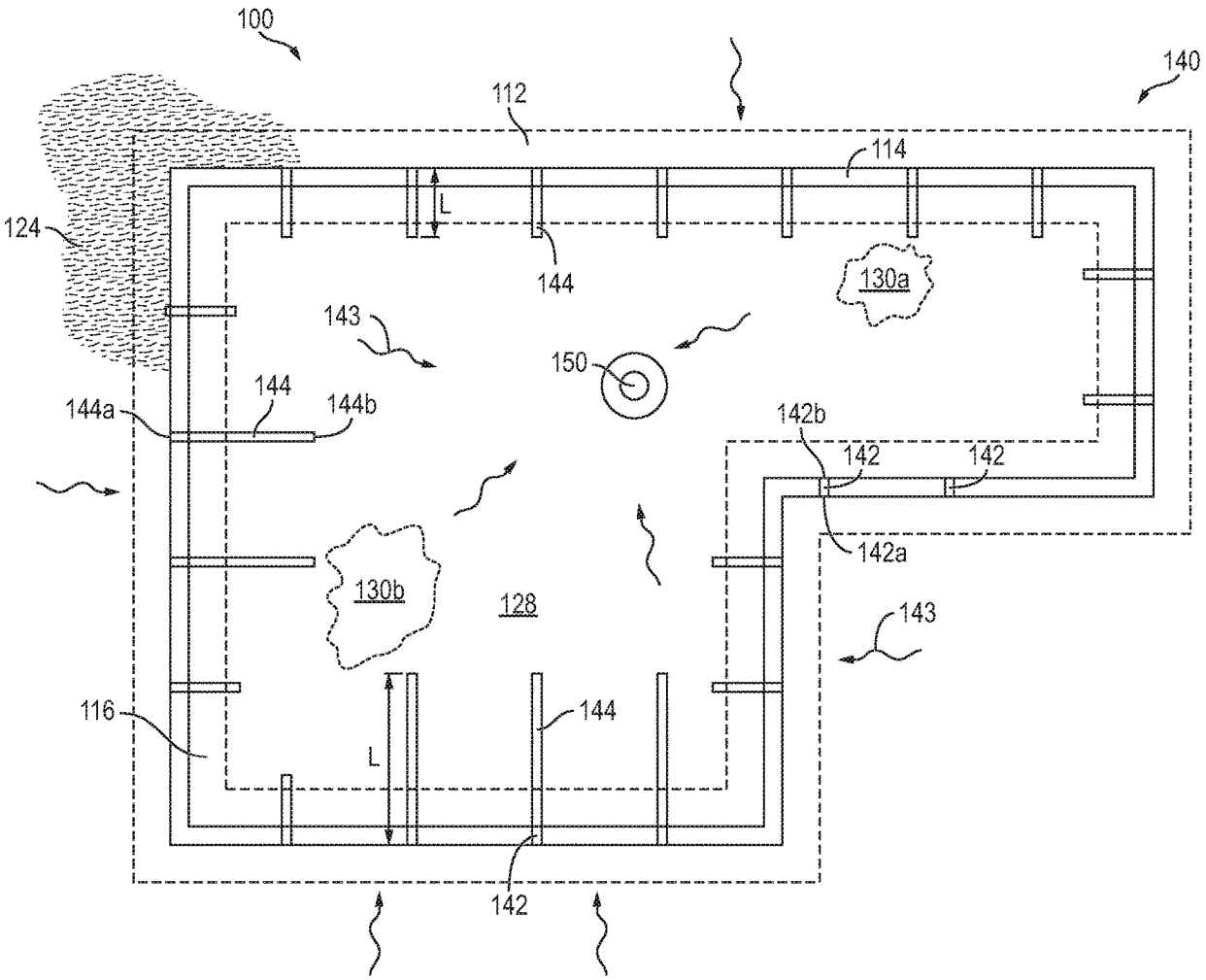

Ventilation openings 142, air intake pipes 144, or both, can be evenly distributed at equal intervals around an entire perimeter of structure 100. Alternatively, spacing among ventilation openings 142 and air intake pipes 144 can vary along a perimeter of structure 100. FIG. 2B shows a plan view of structure 100 and soil moisture control system 140 shown previously in cross-section in FIG. 2A. More specifically, FIG. 2B shows a non-limiting example of how spacing and length of various ventilation openings 142 and air intake pipes 144 can be configured to accommodate for a building footprint, such as corners and jogs in perimeter walls 118 of structure 100. Additionally, moisture control system 140 can be adapted or configured to accommodate for variations in soil moisture content.

Moisture control system 140 can be adapted by adjusting a length of air intake pipes 144. A length of air intake pipes 144 can include a length (L) or minimum distance in a range of about 0.1-1.8 m (or about 0.5-6 feet), or about 0.6-1.2 m (or about 2-4 feet), or about 0.6 or 0.9 m (or about 2 or 3 feet). A minimum length L of air intake pipes 144 can adjust a region in which airflow 143 will actively change or dry moisture content of expansive soil 130. By extending ends 144*b* beyond an edge of footing 116, expansive soil 130 around and in contact with footing 116 will be less affected by airflow 143 than will the soil below slab 126 and away from footing 116. Less airflow 143 around footings 112 can result in little or no soil shrinkage around footings 100. On the other hand, more airflow below floor slab 126 away from footings 112 can result in soil shrinkage below floor slab 126 away from footings 116. Little change in soil moisture content and soil movement around foundation 116 can be desirable to minimize movement of foundation 116, exterior or load-bearing walls 118, and roof 120. Smaller changes in moisture content around foundation 116 is desirable, because even when heaving can be a problem for floor slab 126 and interior walls 118, heaving of foundation 116 can be less of a problem. Furthermore, a soil moisture content of expansive soil 130 below a central area or floor slab 126, can desirably be less than a soil moisture content of an area at a periphery or at a non-central area of floor slab 126. In some embodiments, a central area of floor slab 126, or an area way from a periphery of floor slab 126, can be an area comprising a horizontal offset from any footing 112 of about 0.6-0.9 m (or about 2-3 feet) or more. A moisture content of expansive soil 130 under a central area of floor slab 126 can generally be in a range of about 4-8%, or 4-6%, or about 5%. While a moisture content of expansive soil 130 of about 5% in central area of floor slab can be desirable, a similar moisture content of expansive soil 130 in an area outside the central area can be too low for the expansive soil around footings 112. In an embodiment, moisture content of expansive soil 130 outside a central area of floor slab 126 can generally be in a range of about 8-12%, or 9-11%, or about 10%.

Floor slab 126 and interior (non load-bearing walls) 118 are typically more susceptible to heaving of expansive soil 130 and uplift or movement because the floor slab and non load-bearing walls do not have the weight of structure 100 bearing down on the soil to increase an overburden or force applied to consolidate or prevent expansive soil 130 from moving upwards. Accordingly, foundation 116 and exterior or load-bearing walls 118 are typically less susceptible to heaving of expansive soil 130 and uplift or movement because the foundation and load-bearing walls support weight of structure 100 bearing down on the soil, as well as a depth and weight of soil over the footings 112 adjacent stem 114 that increases an overburden or force applied to consolidate or prevent expansive soil 130 from moving upwards. Thus, adjusting a length of air intake pipes 144 can concentrate a change in moisture content of expansive soil 130 in areas most susceptible to changes in volume and heaving, such as a middle area of floor slab 126.

Adjusting a length of air intake pipes 144 can also concentrate a change in moisture content of expansive soil 130 in areas most in need of a change in moisture content. A distribution of moisture content of expansive soil 130 under structure 100 can be anisotropic, and consistently include patterns of wetter and drier regions under the structure for a variety of reasons, including landscaping, climate, and geology around the structure. For example, a wetter region 130*a* can be in need of greater airflow and greater moisture removal, and as such may have air intake pipes 144 of a shorter length L to increase an area of ABC layer 128 that is exposed to airflow 143 and increase active moisture removal. Conversely, a drier region 130*b* can be in need of lesser airflow and moisture removal, and as such may have air intake pipes 144 of a greater length L to decrease an area of ABC layer 128 that is exposed to airflow 143 and to decrease active moisture removal. As a result, areas of expansive soil 130 most susceptible to changes in volume and heaving, such as a middle area of floor slab 126 that tend to cause the most damage to structure 100 can be targeted. In addition to using the configuration of air intake pipes 144 to control distribution and strength of airflow 143, a size, position, and number of manifolds 152 or exit points for air exhaust systems 150 can also be varied. While FIG. 2B shows a single air exit point to air exhaust system 150 from within ABC layer 128, a plurality of exit points can also be disposed within ABC layer 128.

FIG. 2A also shows one or more moisture sensors 146 can be disposed below floor slab 126 and along a path of airflow 143 between the ventilation openings 142 and air exhaust system 150. The path of airflow 143 can be along or through ABC layer 128, particularly when the moisture control system is added to an existing building, but can also be through other layers or distribution systems including pipes, textiles, or other systems that provide for airflow 143 between ventilation openings 142 and air exhaust system 150. The path of airflow 143 can be along or through a surface 131 of expansive soil 130 and through or along cracks 135 in expansive soil 130. In an embodiment, first side 142*a* of ventilation opening 142 or first side 144*a* of air intake pipe 144 can be variable or adjustable, such as through cover 141, to allow customization of airflow 143 to greater or lesser flow levels by adjusting an aperture or size of one or more opening at first side 142*a* or first side 144*a*.

Moisture sensors 146 can sense an amount of moisture or moisture content in expansive soil 130 and in or along airflow 143, whether the airflow comprises dry air, or moist or humid air that is absorbing or holding water that evaporates from ABC layer 128, expansive soil 130, or both. Multiple sensors 146 can be disposed along an airflow path to sense, measure, or monitor, moisture levels at various locations around or throughout the building and its adjacent soils. Thus a possible position of moisture sensors 146 includes surrounded by expansive soil 130 below ABC layer 128. In some embodiments, a top surface of moisture sensors 146 can be buried below soil 124 or expansive soil 130 and separated from a top surface of the soil by a distance of about 2.5-101.6 cm, 45.7-76.2 cm, or 61.0 cm (or about 1-40 in., 18-30 in., or 24 in.). The amount of airflow 143 or moisture being withdrawn, or added, can be increased or decreased as part of an active or passive feedback system based on a desired setpoint or moisture level by using processor 158 and one or more moisture sensors 146, which can be in electrical communication with each other using wires or wirelessly. For example, as weather patterns change, and ambient humidity increases or decreases, the amount of airflow 143 and moisture removal from expansive soil 130 beneath structure 100 can change based on changing ambient conditions. Additionally, a newly installed soil moisture control system 140 may initially operate more aggressively or at higher levels for greater moisture content removal from expansive soil 130 to remedy an existing problem until a steady state or desirable condition is achieved, at which point soil moisture control system 140 can then operate at a less aggressive or lower level. An amount of moisture change can be controlled either actively or passively according to the measurements received by the one or more moisture sensors 146. In fact, different zones or areas can operate at different levels for varying amount of moisture removal from expansive soil 130 to account for varying or differing soil conditions below an entire area of structure 100.

When a heaving problem is being mitigated or remediated by removal of moisture from expansive soil 130, as moisture is drawn out of expansive soil 130 by airflow 143 through ABC layer 128, cracks and fissures 135 can form in expansive soil 130. As cracks 135 develop, additional surface area at lower levels or layers in expansive soil 130 are exposed, thereby increasing a depth at which moisture can be extracted by evaporation from the expansive soil. As moisture is withdrawn, expansive soil 130 is dried to a lower moisture content, decreases in size, and removes pressure and stress previously applied to structure 100, and particularly to floor slab 126 that was present during heaving of expansive soil 130 when expansive soil 130 was expanding upwards due to higher than normal moisture content levels. While distances traveled by moisture through expansive soils will vary, moisture such as liquid water can travel as little as about 7.6 cm (or about 3 in.) in a year. Distanced traveled by moisture is greatly increased when assisted by suction or wicking, such as can occur through the voids of ABC layer 126, and through cracks 135.

While volumes and distances of soil expansion and contraction can vary greatly based on specific soil types, in situ conditions, and engineering specifications, in some instance expansive soil 130 can, without limitation, rise or fall a distance of about 0-10.2 cm (or about 0-4 in.) when a moisture content of the expansive soil is about 8-12% or more, including about 10%. Preferably, the moisture content of expansive soil 130 below and near footings 112 will be prevented from getting too low so the soil does not shrink and settlement of structure 100 does not become problematic. In this context, near footings 112 can includes distances of about 0-1.1 m (or about 0-3.5 feet). In some instances, a moisture content below and around footings 112 will be maintained unchanged, or substantially unchanged (such as within 0-3% of an original moisture content or with less than about 0.6 cm (or about ¼ in.) of vertical soil movement), so that damage to structure does not result from movement or differential movement of foundation 116. In some embodiments, moisture content of expansive soil 130 can be greater than or equal to about 5% below floor slab 126, and higher near footings 112, such as about 8% moisture content.

FIG. 2A also shows a manifold, perforated compartment, perforated pipe, or air exchange 152. Manifold 152 can be a piece of pipe, tubing, a box, housing, or other suitable structure made of plastic, metal, ceramic, or other suitable material that includes an air permeable surface that allows air and airflow 143 to be drawn from ventilation openings 142 and air intake pipes 144, through ABC layer 128, to air exhaust system 150. Manifold 152 can be integrally formed with an air exhaust system 150, or separately formed and subsequently connected to air exhaust system 150. Manifold 152, like the rest of soil moisture control system 100, can be installed at the time of original construction of structure 100, such as about when floor slab 126 is being formed or poured. An opening 148 can be formed or preserved in or through floor slab 126 and extend to ABC layer 128 during formation, placement, or pouring of floor slab 126. Manifold 152 can also be installed after a time of original construction, such as during a renovation, remodel or retrofit, after the floor slab has been formed. For remodels, a section of the floor slab 126 can be removed to form opening 148, such as by sawing, drilling, coring, or other suitable process. A depth or height of opening 148, in a vertical direction, can be equal to a thickness of floor slab 126, and as such can comprise a distance of about 7.6-17.8 cm, or about 10.2 cm (or about 3-7 in. or about 4 in.). A diameter or cross-sectional width of opening 148, taken in a direction transverse or perpendicular to the depth or height of opening 148 can be in a range of about 2.5-30.5 cm or about 15.2 cm (or about 1-12 in. or about 6 in.). A cross-sectional area of ventilation opening can comprise a shape that is circular, oval, square, rectangular, or any other geometric or organic shape.

While one manifold 152 inserted within opening 148 is illustrated in the cross-sectional view of FIG. 2A, multiple openings 148, manifolds 152, and air exhaust pipes 154 can be included at various locations within structure 100 according to the configuration and design of air exhaust system 150 and soil moisture control system 140. In an embodiment, additional moisture control sensors 146 can be disposed within an air exhaust system 150 to measure moisture content or humidity of airflow 143 before or after withdrawing, or adding, moisture from expansive soil 130. Moisture content and humidity of ambient air outside structure 100 can also be measured and actively or passively monitored. In some embodiments, manifold 152 and air exhaust pipes 154 can be disposed near, adjacent, or within an interior wall 118 of structure 100 so that air exhaust pipe 154 can be hidden within one or more interior or exterior walls of structure 100, so as to be out of sight of building occupants while circulating airflow 143 throughout soil moisture control system 140.

Air exhaust pipes 154, can be of plastic, such as PVC, ABS, or other suitable plastic, as well as metal, including copper, iron, cast iron, stainless steel, galvanized steel, ceramic, or other suitable material that can be rigid or flexible, and can comprise a circular cross-section, a square cross-section, or any other cross-section. Air exhaust pipes 154, as well as an entirety of air exhaust system 150, can be hidden from view of building users by being disposed within walls 118, in attics, within soffits or dead spaces, and adjacent other building systems, conduits, piping, or infrastructure. A plurality of interconnecting air exhaust pipes 154 can be coupled and interconnected to one or more manifolds 152 and one or more fans 156 according to the configuration and design of air exhaust system 150 and soil moisture control system 140.

FIG. 2A also shows an air exhaust pipe, tube, or conduit 154 comprising first side 154*a* and a second side 154*b*, as well as a fan or variable speed fan 156. At least one fan 156 can be coupled along the airflow path or to air exhaust pipe 154 to draw air from ventilation openings 142 and along ABC layer 128 below the building to an area outside or external to structure 100. In an embodiment, fan 156 can be coupled at or near an end of exhaust pipe 154 outside structure 100 to be disposed over, or adjacent, wall 118 or roof 120. Alternatively, or additionally, the at least one fan 156 can be coupled in-line along any portion of the path of airflow 143, such as in-line with air exhaust pipe 154 inside structure 100. Any number and size of fans 156 can be incorporated within the soil moisture control system. Advantageously, use of multiple fans 156 or a network of air exhaust pipes 154 including gates or valves can allow for one or more fans 156 to target specific zones of expansive soil 130 below floor slab 126 for varying levels or rates of moisture removal. Varying levels or rates of moisture removal from expansive soil 130 can vary based on different moisture levels, such as wetter region 130*a* and dryer region 130*b* shown in FIG. 2B. When expansive soil 130 is being dried to reduce heaving and swelling, more moisture removal will occur in wetter region 130*a* and less or no moisture removal will occur in dryer region 130*b*. To the contrary, when expansive soil 130 is being moistened to reduce shrinkage of expansive soil 130, more moisture will be added to dryer region 130*b* and little or no moisture removal will occur in wetter region 130*a*.

Fans 156 can include variable speed fans that can be adjusted to increase or decrease airflow 143 to increase or decrease a rate of moisture change in expansive soil 130. Fan 156 can be a commercially available fan that is for sale at big box home improvement retailers, such as Blue Hawk power ventilation unit, or any other suitable unit. A rate of airflow 143 can be automatically adjusted as part of a active feedback system using a central processor 158 that can collect and use data provided by moisture sensors 146. In other embodiments, a rate of airflow 143 at ventilation openings 142 can be adjusted by changing a size of openings or apertures of covers 141 while maintaining a constant or consistent airflow 143 at the one or more fans 156.

Accordingly, by controlling and regulating moisture content of soils beneath and around structure 100, including expansive soils 130 under buildings using slab on grade construction, problems of heaving and settling can be mitigated in a cost-effective way to prevent costly structural problems and repairs. In some embodiments, a moisture control system 140 in accordance with the present disclosure could be installed during construction of a new building for a price in a range of $300-$400 2014 US dollars, which is much less than conventional soil and structural remediation practices that can typically cost in a range of about $5,000-$15,000 2014 US dollars.

Any of the soil moisture control systems or variations disclosed herein can apply to structures 100 that are not built using slab on grade techniques, as well as be applicable to multi-story structures, structures including basements, foundations of other structures or devices such as pipelines, and other improvements reliant on soils such as runways and roadways.

In conjunction with the various features, elements, and components discussed above, in addition to regulating airflow 143 to adjust moisture content of expansive soil 130 beneath structure 100, controls can also be exercised to limit a transfer of moisture in soil 124 or expansive soil 130 from areas around and below structure 100. For example, a barrier or curtain can be established that extends vertically downward from foundation 116 to a depth of about 1.8 m (or about 6 feet) or more, which would prevent moisture from moving laterally into or away from a footprint or area below a structure 100. By having the curtain or barrier extend to a depth of about 1.8 m (or about 6 feet), heaving problems, which mostly occur in the top 0.6-0.9 m (or 2-3 feet) of expansive soils like expansive soil 130 are generally avoided. The distance or depth of the curtain can, of course, be adjusted based on in-situ conditions including soil type, and prevailing water flows and conditions.

The barrier or curtain can be a mechanical or chemical barrier that prevents the movement of water. A physical barrier can be established by digging and filling a trench with a material that prevents the flow of water through the physical barrier. Tree sap can also be placed in a trench or poured out at a surface of soil 124 or of expansive soil 130 and allowed to flow or percolate through the soil to bond with the soil and form a physical or mechanical barrier. Alternatively, a hydrophobic substance such as polyurethane can be placed in a trench or poured out at a surface of soil 124 or of expansive soil 130 and allowed to flow or percolate through the soil to bond with the soil and form a chemical barrier to water passage. By limiting the transmission of moisture into soil 124 or expansive soil 130 below structure 100, in conjunction with controlling moisture content of expansive soil 130 below or within a footprint of structure 100, removing or adding moisture to the soil through airflow 143 along upper layers of the soil, can result in better control over soil moisture content.

Figure 3:
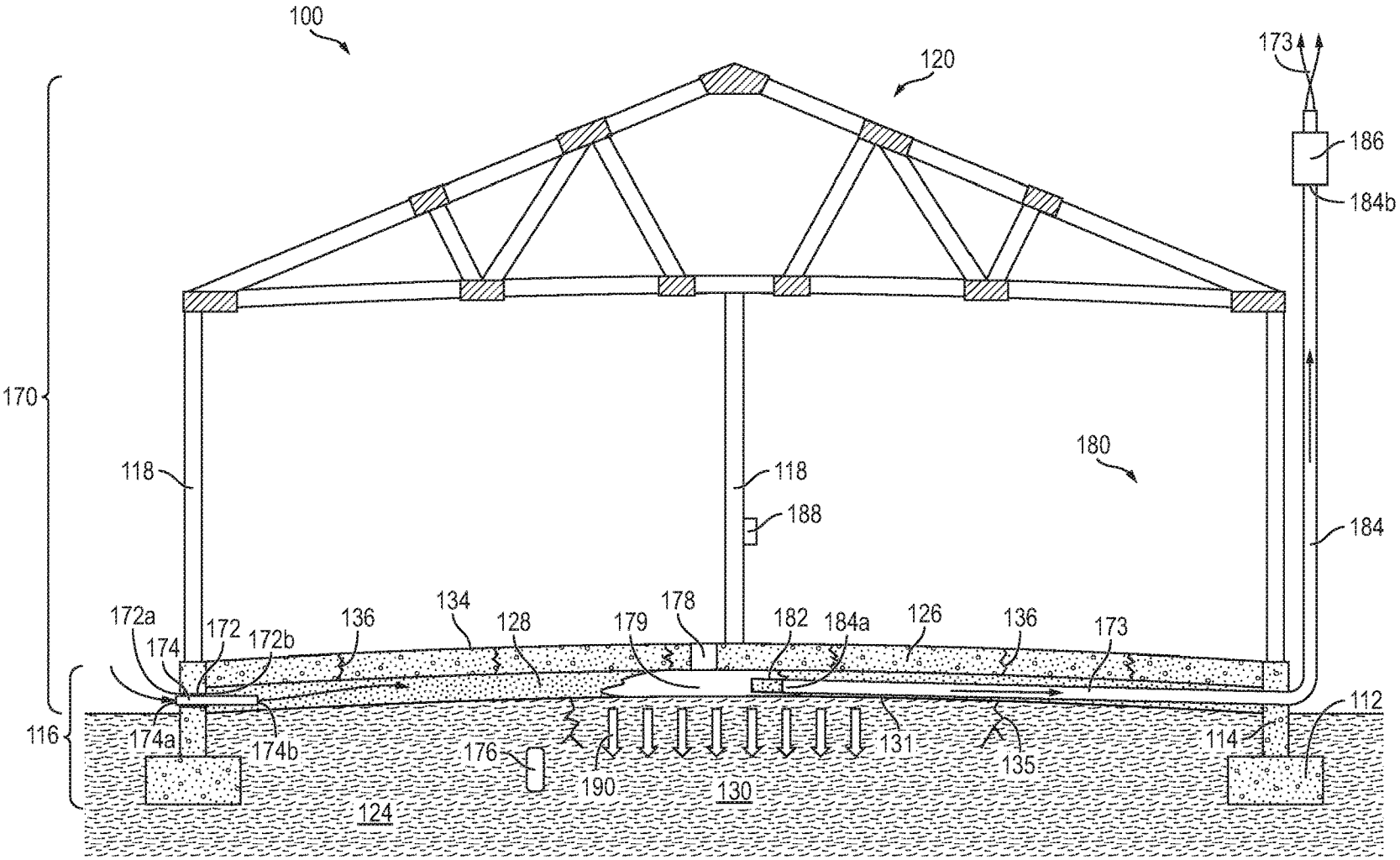
FIG. 3 shows a cross-sectional view of other aspects of a system for stabilizing structures by control of soil moisture content.

FIG. 3 shows various aspects of a soil stabilization system comprising soil moisture control system 170. Soil moisture control system 170, like soil moisture control system 140, can be implemented in structure 100, which has been described above. Features of soil moisture control system 170 including cover, insert, grate, filter, or screen 171, ventilation openings or holes 172, airflow 173, air intake pipes, tubes, or conduits 174, screen, valve, or filter 175, and moisture sensor 176, can be similar or identical to cover, insert, grate, filter, or screen 141, ventilation openings or holes 142, airflow 143, air intake pipes, tubes, or conduits 144, screen, valve, or filter 145, and moisture sensor 146, respectively.

A number of differences exist between FIG. 2A and FIG. 3. For example, floor slab 126 in FIG. 2A is shown with an uneven surface 134 and cracks 136 that result from swelling and heaving of expansive soil 130. Thus, FIG. 3 can be illustrative of a situation in which soil moisture control system 170 is installed at a time after initial construction of structure 100 and after expansion of expansive soil 130. As shown in FIG. 3, expansion of expansive soil 130 might have become a problem for structure 100, by causing soil heave that results in movement or formation of uneven surface 134, cracks 136 with accompanying shifting of internal walls 118, door jams, and other features of structure 100. Alternatively, soil moisture control system 170 can be installed before some or all of the above-described problems are manifest, thereby serving to prevent rather than mitigate one or more of the problems indicated above. In other embodiments, soil moisture control system 170 can be used to prevent or mitigate problems arising from or relating to soil shrinkage.

Another difference between soil moisture control system 140 and soil moisture control system 170 can be a size shape and method of formation of opening 178 and cavity 179 with respect to opening 148 and cavity 149, respectively. Opening 178 can be similar or identical to opening 148, as described above. A use of opening 178 can differ from that of opening 148 in that in soil moisture control system 170, manifold 182 and air exhaust pipe 184 do not extend through the opening. Instead, opening 178 can be formed as a way for accessing ABC layer 128 and removing or excavating a portion of the ABC layer, expansive soil 130, or both, to form a cavity 179 in ABC layer 128, expansive soil 130, or both. While opening 178 can be of any size, including sizes larger than a size of opening 148, opening 178 can be closable or filled after the excavation of cavity 179, such as by patching floor slab 126. Thus, while opening 178 might be larger than opening 148 to better facilitate formation of cavity 179, a larger opening 178 could also make closing-up or patching-up opening 178 more difficult.

As indicated above, cavity 179 can be formed by excavating or removing a portion of ABC layer 128, expansive soil 130, or both. A size of cavity 179 can include a depth in a range of about 10.2-40.6 cm (or about 4-16 in.), a length in a range of about 15.2-121.9 cm (or about 6-48 in.), and a width in a range of about 15.2-121.9 cm (or about 6-48 in.). Cavity 179 can include cavity walls of exposed ABC layer 128 or expansive soil 130, as well as cavity walls made of plastic, metal, concrete, cement, plaster, textiles, or other suitable materials. Cavity 179 can provide an area in which airflow 173 can circulate as well as provide an area in which manifold 182 and a portion of air exhaust pipe 184 may extend. A size of 179 will generally be limited to a distance less than what cause structural failures in floor slab 126, which in the case of a concrete floor slab 128 comprising a thickness of about 10.2 cm (or about 4 in.), can be up to about 1.2-1.5 m (or about 4-5 feet).

Additionally, FIG. 3A also shows that a soil moisture control system such as soil moisture control system 170 can comprises an air exhaust system 180 that differs from air exhaust system 150 by not extending through a central or livable portion of structure 100. Instead, air exhaust system 180 can be partially or completely disposed outside of a livable space of structure 100. Thus first side 184*a* and an adjacent portion of air exhaust pipe 184 can be disposed below floor slab 126 from a central area of structure 100 to a periphery or perimeter of the structure. Second side 184*b* and an adjacent portion of air exhaust pipe 184 can be disposed along an outer wall 118 of structure 100. In instances when air exhaust system 180 is installed during original construction, manifold 182 and air exhaust pipe 184 can be placed before the formation of floor slab 126, so that openings in floor slab 126 do not need to be formed and excavation of ABC layer 128 and of expansive soil 130 can be minimized by grading the ABC layer and expansive soil 130 around exhaust system 180. In instances in which air exhaust system 180 is installed after original construction, such as part of a retrofit, additional excavation, such as with a mole, can be required to prepare a space for placement of manifold 182 and air exhaust pipe 184. The additional excavation can also include formation of an additional access opening in stem wall 114 for air exhaust pipe 184.

In either event, when soil moisture control system 170 is in place and operational, an elevation or level of floor slab 126, ABC layer 128, and expansive soil 130 can be reduced as indicated by arrows 190 to reduce swelling and heaving. An amount of soil movement will vary with soil type, moisture levels, consolidation profiles, and other factors. However, in some embodiment changes in an elevation to floor slab 126, ABC layer 128, and expansive soil 130 of about 0-7.6 cm or more are possible (or about 0-3 in. or more). In some instances soil shrinkage of about 3.8-5.1 cm (or about 1.5-2.0 in.) in a period of about 5 months have been observed.

Figure 4:
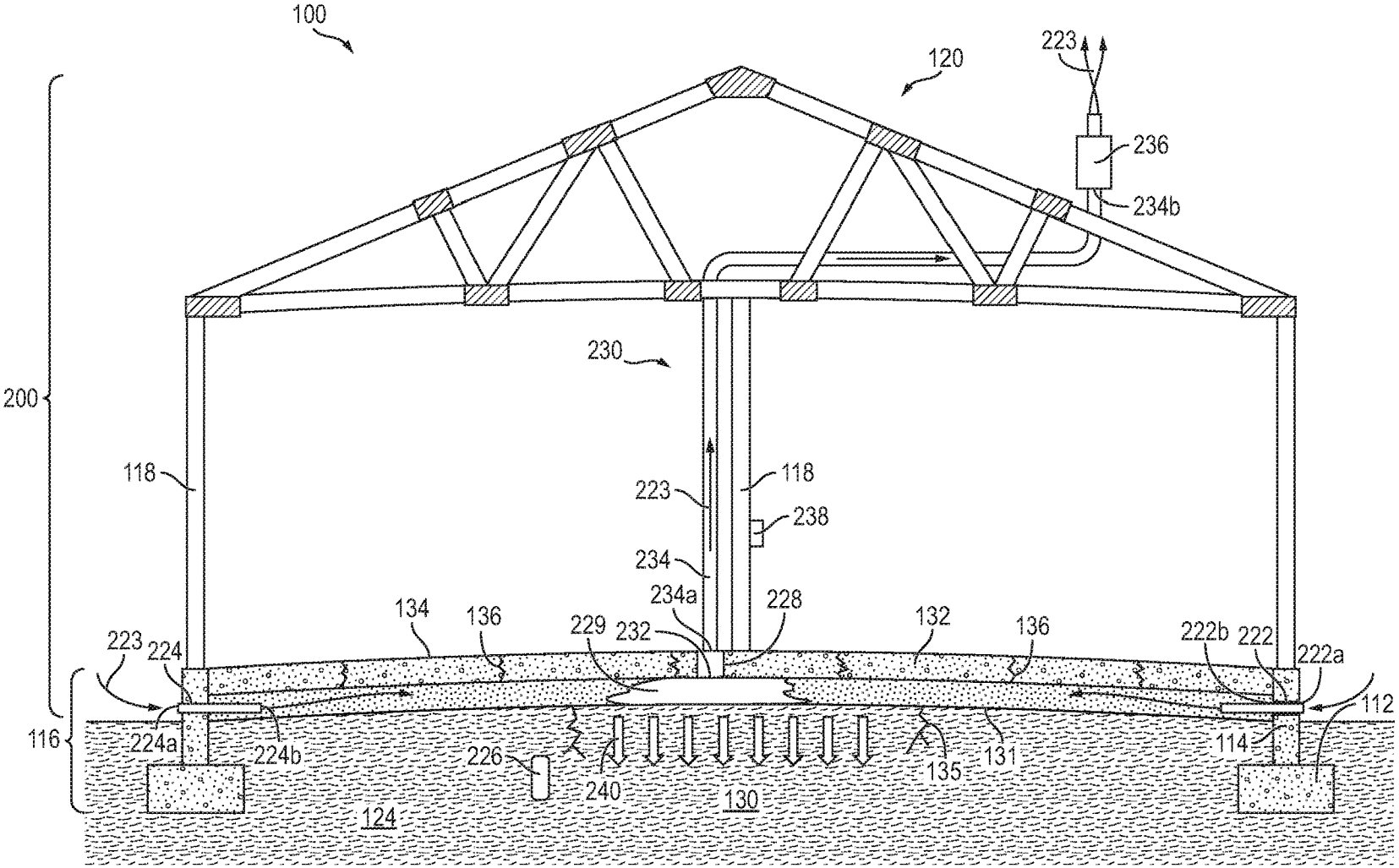
FIG. 4 shows a cross-sectional view of other aspects of a system for stabilizing structures by control of soil moisture content.

FIG. 4 shows another embodiment of a soil moisture control system, soil moisture control system 200. Soil moisture control system 200 and structure 100 of FIG. 4 differs from the soil moisture control system 140 of FIG. 2A by inclusion floor slab 126 with uneven surface 134 and cracks 136 as shown in FIG. 3. FIG. 4 also differs from FIG. 2A by inclusion of cavity 229 that can be similar or identical to cavity 179 shown and described above with respect to FIG. 3. Additionally, manifold, perforated compartment, perforated pipe, or air exchange 232 can be disposed within opening 228 and extend to a perimeter or periphery of cavity 229 without extending into the cavity. As such, the opening in manifold 232 can be disposed on a single side or surface of the manifold that is exposed with respect to cavity 229. Arrows 240 in FIG. 4 are similar to arrows 190 in FIG. 3 and indicate that when soil moisture control system 200 is in place and operational, an elevation or level of floor slab 126, ABC layer 128, and expansive soil 130 can be reduced as indicated by arrows 240 to reduce swelling and heaving 240.

Figure 5A:
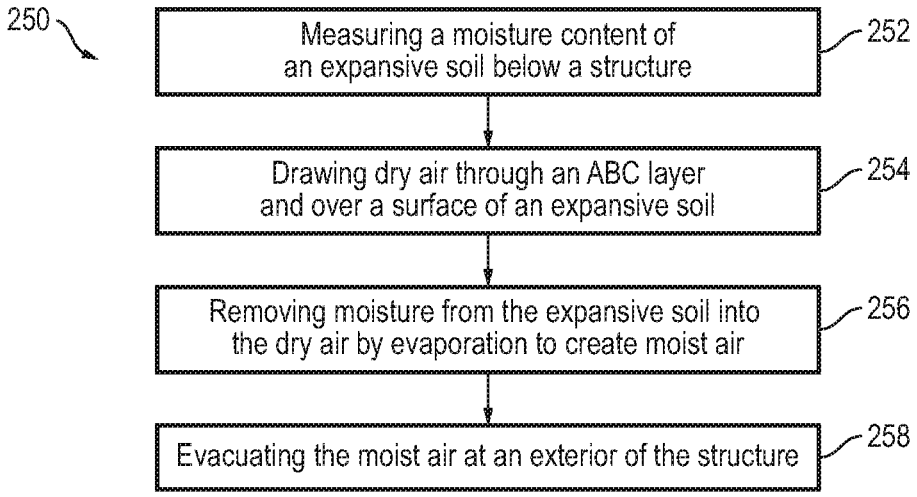
FIGS. 5A and 5B show flowcharts of various methods in accordance with the disclosure.
Figure 5B:
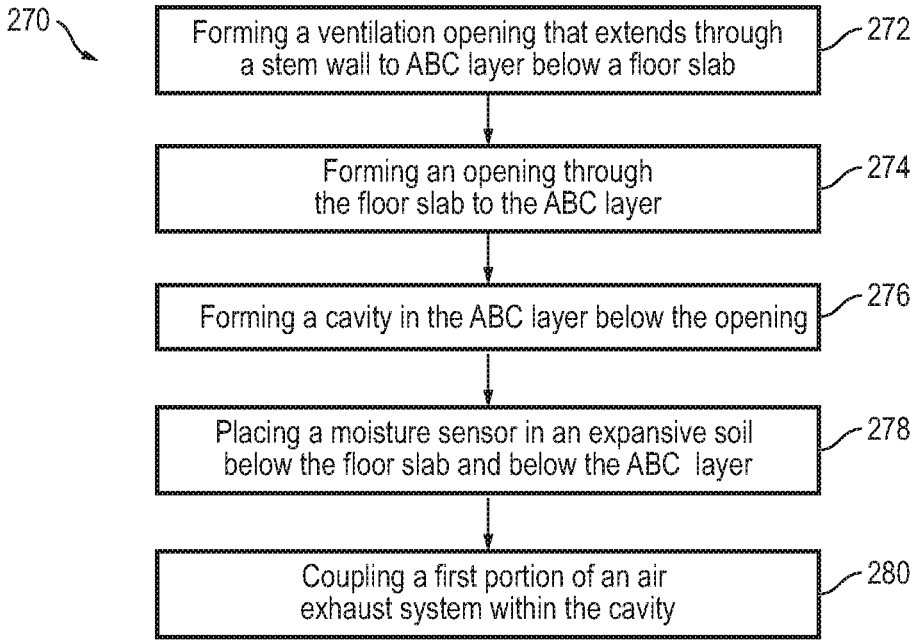

FIGS. 5A and 5B show a number of flow charts for a method of stabilizing soils and method of installing a soil stabilization system, respectively. FIG. 5A shows a flowchart 250 that shows a method of soil stabilization for a structure. At block 252 the method includes measuring a moisture content of an expansive soil below a structure. At block 254 the method includes drawing dry air through an ABC layer and over a surface of an expansive soil. At block 256 the method includes removing moisture from the expansive soil into the dry air by evaporation to create moist air. At block 258 the method includes evacuating the moist air at an exterior of the structure.

FIG. 5B shows a flowchart 270 that shows a method of installing a soil stabilization system for a structure. At block 272 the method includes forming a ventilation opening that extends through a stem wall to an ABC layer below a floor slab. At block 274 the method includes forming an opening through the floor slab to the ABC layer. At block 276 the method includes forming a cavity in the ABC layer below the opening. At block 278 the method includes placing a moisture sensor in an expansive soil below the floor slab and below the ABC layer. At block 280 the method includes coupling a first portion of an air exhaust system within the cavity.

Where the above examples, embodiments, and implementations reference examples, it should be understood by those of ordinary skill in the art that other systems, devices, and examples could be intermixed or substituted with those provided. In places where the description above refers to particular embodiments of soil moisture, stabilization, and constructions methods, it should be readily apparent that a number of modifications may be made without departing from the spirit thereof and that these embodiments and implementations may be applied to other technologies as well. Accordingly, although particular component examples may be disclosed, such components may be comprised of any shape, size, style, type, model, version, class, grade, measurement, concentration, material, weight, quantity, and/or the like consistent with the intended purpose, method and/or system of implementation. Thus, the presently disclosed aspects and embodiments are, therefore, to be considered in all respects as illustrative and not restrictive. The disclosed subject matter is intended to embrace all such alterations, modifications, and variations that fall within the spirit and scope of the disclosure and the knowledge of one of ordinary skill in the art, as set forth in the claims.

What is claimed is:

1. A method of soil stabilization for reducing heave in a slab on grade structure, comprising:

identifying heave of an expansive soil below a slab of the slab on grade structure by identifying movement of the slab;

providing a ventilation opening formed in a stem wall below the slab of the slab on grade structure;

providing an air intake pipe coupled to the ventilation opening, the air intake pipe including a minimum length (L) of 0.6 meters (m) such that airflow through an end of the intake pipe opposite the ventilation opening is offset at least 0.6 m from an edge of a footing;

providing an air exhaust manifold;

drawing dry air through the ventilation opening, through the air intake pipe, through an aggregate base course (ADC) layer comprising a thickness in a range of 3-6 inches, and over a surface of the expansive soil below the slab, wherein the ABC layer is in contact with the surface of the expansive soil;

removing moisture from the expansive soil into the dry air by evaporation to reduce a volume and the heave of the expansive soil while reducing the movement of the slab and creating moist air below the slab; and moving the moist air from below the slab through the exhaust manifold and to an area outside the structure to evacuate the moist air at an exterior of the structure.

2. The method of claim 1, further comprising directing greater airflow to a wetter region of the expansive soil and lesser airflow to a drier region of the expansive soil.

3. The method of claim 2, further comprising adjusting a cover coupled to the ventilation opening to adjust an airflow through the ventilation opening.

4. The method of claim 3, further comprising drawing the air through the ABC layer and evacuating the air by operating a fan when a measured moisture content of the expansive soil below the structure is greater than or equal to 5 percent.

5. The method of claim 3, further comprising operating more than one fan to control an airflow below different portions of the structure.

6. The method of claim 1, further comprises measuring a moisture content of the expansive soil with a sensor at a location whose distance is greater than or equal to 0.9 meters from every footing of the structure.

7. The method of claim 1, further comprising measuring a moisture content of the expansive soil at a depth below a top surface of the expansive soil in a range of 2.5-101.6 centimeters.

8. A method of soil stabilization for reducing heave in a slab on grade structure, comprising:

identifying heave of an expansive soil below a slab of the slab on grade structure;

providing an air intake pipe below the slab, the air intake pipe including a length (L) in a range of 0.1-1.8 meters (m) such that airflow through an end of the intake pipe is offset from an edge of a footing of the slab on grade structure;

drawing dry air through the air intake pipe, through an aggregate base course (ABC) layer, and over a surface of the expansive soil below the slab on grade structure, wherein the ABC layer is in contact with the surface of the expansive soil;

removing moisture from the expansive soil into the dry air by evaporation to reduce a volume and the heave of the expansive soil and create moist air; and evacuating the moist air at an exterior of the structure.

9. The method of claim 8, wherein the length (L) of 0.6 meters (m) coupled to the ventilation opening such that airflow through an end of the intake pipe is offset at least 0.6 m front an edge of the footing.

10. The method of claim 9, further comprising directing greater airflow to a wetter region of the expansive soil and lesser airflow to a drier region of the expansive soil.

11. The method of claim 10, further comprising drawing the air through the ABC layer and evacuating the air by operating a fan when a measured moisture content of the expansive soil below the structure is greater than or equal to 5 percent.

12. The method of claim 8, further comprises measuring a moisture content of the expansive soil at a location whose distance is greater than or equal to 0.9 meters from every footing of the structure.

13. The method of claim 8, further comprising measuring a moisture content of the expansive soil at a depth below a top surface of the expansive soil in a range of 2.5-101.6 centimeters.

14. A method of soil stabilization for reducing heave in a slab on grade structure, comprising:

identifying heave of an expansive soil below the slab of the slab on grade structure;

drawing dry air through a ventilation opening formed below the slab of the structure, through an aggregate base course (ABC) layer, and over a surface of an expansive soil below the structure;

removing moisture from the expansive soil into the dry air by evaporation to reduce a volume and the heave of the expansive soil and create moist air; and evacuating the moist air at an exterior of the structure.

15. The method of claim 14, further comprising the ventilation opening formed in a stem wall of the structure.

16. The method of claim 14, further comprising an air intake pipe including a minimum distance or length (L) of 0.6 meters (m) coupled to the ventilation opening such that airflow through an end of the intake pipe is offset at least 0.6 m from an edge of the footing.

17. The method of claim 16, further comprising adjusting a cover coupled to the ventilation opening to adjust an airflow through the ventilation opening.

18. The method of claim 17, further comprising drawing the air through the ABC layer and evacuating the air by operating a fan when a measured moisture content of the expansive soil below the structure is greater than or equal to 5 percent.

19. The method of claim 17, further comprising directing greater airflow to a wetter region of the expansive soil and lesser airflow to a drier region of the expansive soil.

20. The method of claim 14, further comprises measuring a moisture content of the expansive soil at a location whose distance is greater than or equal to 0.9 meters from every footing of the structure.

* * * * *